US007476828B2

(12) United States Patent
Genua

(10) Patent No.: US 7,476,828 B2
(45) Date of Patent: Jan. 13, 2009

(54) MEDIA MICROWAVE OVEN

(76) Inventor: Marc Genua, 196 Elson Street, Markham, Ontario (CA) L3S 3C8

( * ) Notice: Subject to any disclaimer, the term of this patent is extended or adjusted under 35 U.S.C. 154(b) by 295 days.

(21) Appl. No.: 11/397,096

(22) Filed: Apr. 4, 2006

(65) Prior Publication Data

US 2007/0131677 A1 Jun. 14, 2007

(51) Int. Cl.
*H05B 6/64* (2006.01)

(52) U.S. Cl. ..... 219/679; 219/678

(58) Field of Classification Search ..... 219/679, 219/678, 601, 680

See application file for complete search history.

(56) References Cited

U.S. PATENT DOCUMENTS 3,773,979 A * 11/1973 Kirk et al. ..... 370/487
6,067,570 A * 5/2000 Kreynin et al. ..... 709/227
6,359,270 B1 * 3/2002 Bridson ..... 219/679
6,480,753 B1 * 11/2002 Calder et al. ..... 700/83
6,557,756 B1 * 5/2003 Smith ..... 235/379
2005/0023311 A1 * 2/2005 Allen et al. ..... 224/257

* cited by examiner

*Primary Examiner*—Daniel L Robinson
(74) *Attorney, Agent, or Firm*—Peter L. Brewer; Baker, Donelson, Bearman, Caldwell & Berkowitz, PC

(57) ABSTRACT

A media microwave oven for showing videos at a workplace. The media microwave oven includes: a microwave oven; a display screen embedded in the door of the microwave oven; a speaker; and a lockable compartment containing a computer system. The computer system comprises: a microprocessor, connected memory, mass capacity storage; a first software component for retrieving the at least one advertising video from the storage and transmitting the advertising video to the display screen and the speaker; and a second software component for managing the sequence and time of showing the advertising videos, wherein the advertising videos are shown repeatedly.

18 Claims, 2 Drawing Sheets

MEDIA MICROWAVE OVEN

STATEMENT OF RELATED APPLICATIONS

This application is related to pending Canadian Patent Application No. 2509708 filed on or about Dec. 10, 2005. That application is entitled "Media Microwave Oven."

TECHNICAL FIELD OF THE INVENTION

The present invention relates to a microwave oven. In particular, the invention relates to a microwave oven for displaying a marketing or instructional message.

BACKGROUND OF THE INVENTION

Microwave ovens for heating foodstuff are widely used in both residential and commercial/industrial contexts. A microwave oven heats food by using microwave radiation generated from a magnetron, many times faster than conventional means, often without the risk of burning the foodstuff. An oven includes controls to enable a user to adjust output levels and cooking time. Cooking time may be determined by reference to an absolute period of time or the sensed temperature of the heated foodstuff, amongst other ways. Typically, a microwave oven also includes displaying functionality for visually indicating to the user the operational status of the microwave oven when in or prior to heating operation.

Once the heating function has been engaged by a user, there is a period during which the foodstuff is irradiated and the user must wait for the period to terminate before extracting his foodstuff. This period can vary greatly in duration; it may last less than a minute or in certain cases up to tens of minutes. Typically, to heat a prepared meal, a few minutes will suffice. The user has to then opt whether to wait idly for the cooking time to expire or to leave the cooking area and return in a pre-determined amount of time. In the latter case, there is often the possibility of not being able to return in time, resulting in cooling of the foodstuff and necessitating a further heating. The problem is even more difficult if the heating period is determined by way of temperature sensing. In this instance, there is no way of knowing in advance how long irradiation will occur.

In the commercial/industrial context where workers are allocated a fixed period within which to eat and an eating area separate from the work area, a queue often occurs for sequential use of a limited number of microwave ovens in the eating area. Leaving the eating area is not an option, except if someone could be found to look after the foodstuff; neither would a worker leave once joining a queue. The only option is to wait in the area of the microwave oven both before and during heating. During this time, there is an unproductive void when hungry and impatient people wait.

SUMMARY OF THE INVENTION

This invention addresses the problem as indicated above by providing for a media microwave oven, in particular a single unit with a microwave oven and a computer for displaying an advertising or instruction video. The oven may be placed in a workplace to be seen by employees. The video may run repetitively. The video preferably includes both a visual and an audio component.

Generally, the oven includes a microwave oven having a door. The oven also has a display screen attached to the door for displaying the visual component of the at least one advertising or instructional video. The over further includes a speaker for playing the audio component of the at least one advertising or instructional video. Still further, the oven has a lockable compartment containing a computer system.

In one embodiment, the computer system comprises a microprocessor and memory connected to the microprocessor; storage for the at least one advertising or instructional video in an electronic format; a first software component under control of the microprocessor for retrieving the at least one advertising or instructional video from the storage and transmitting the visual component of the at least one advertising or instructional video to the display screen and the audio component to the speaker; and a second software component under control of the microprocessor for managing a sequence and time of showing the at least one advertising or instructional video using the first software component, wherein the at least one advertising or instructional video is shown repeatedly.

BRIEF DESCRIPTION OF THE DRAWINGS

So that the manner in which the features of the present invention can be better understood, certain drawings are appended hereto. It is to be noted, however, that the drawings illustrate only selected embodiments of the inventions and are therefore not to be considered limiting of scope, for the inventions may admit to other equally effective embodiments and applications.

DETAILED DESCRIPTION OF THE PREFERRED EMBODIMENTS

Figure 1:
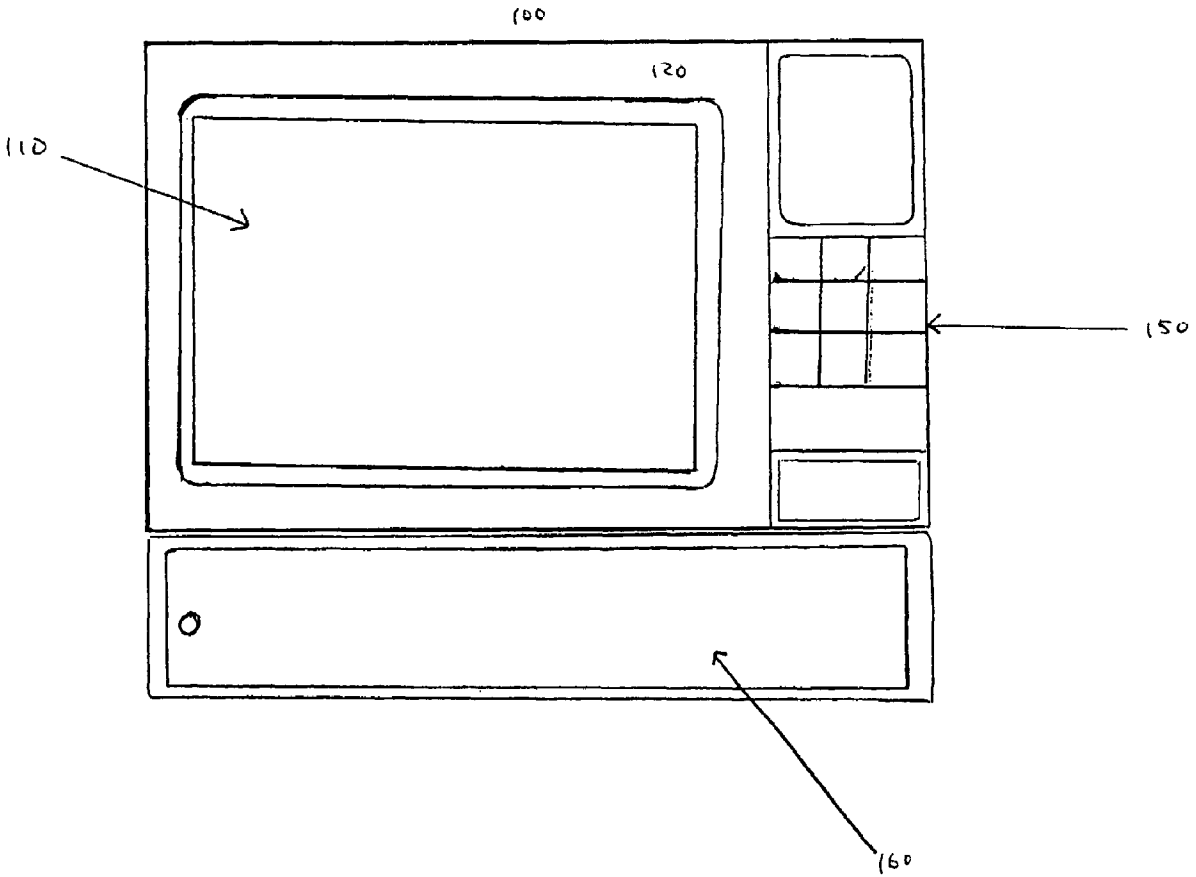
FIG. 1 is a frontal view of a preferred embodiment of the invention.
Figure 2:
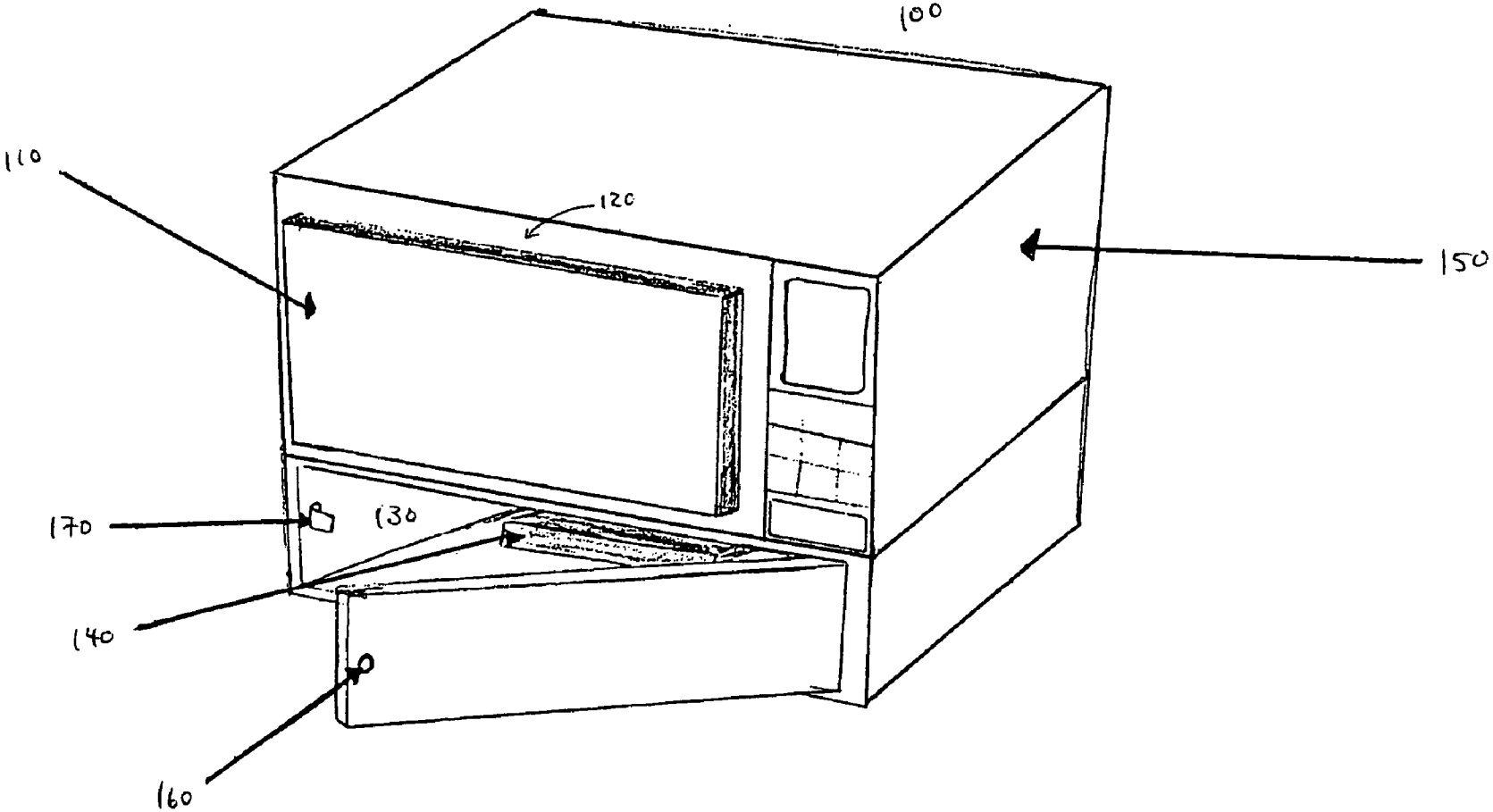
FIG. 2 is a perspective view of the preferred embodiment of the invention shown in FIG. 1 with the door to the compartment opened.

As indicated in FIGS. 1 and 2, a preferred embodiment of the invention is a media microwave oven 100 consists of a standard microwave oven 150 with a flat display screen 110 attached to or embedded in the door 120 of the media microwave oven 100. The media microwave oven 100 has an integrated or attached lockable compartment 130. In a preferred embodiment, the compartment 130 is fastened to the underside of the media microwave oven 100. This lockable compartment 130, openable by a physical key or a combination (as shown in FIG. 2, a door 160 openable by key and engaging with a latch 170 in the compartment 130), contains a computer system 140, which is electronically connected to the display screen 110. The display screen 110 is preferably of the LCD or the plasma type, but is not excluded to such.

The computer system 140 may have one or more electronic input port (such as a USB port, an RJ-11 jack, an RJ-45 port, an RS-232 port, an RS-422/485 port, or a current loop port; not shown), accessible from the exterior of the compartment 130 for receiving data without having to have direct access to the computer system 140. Similarly, there may be one or more electronic interface ports (such as a keyboard port or a mouse port) accessible from the exterior of the compartment 130 for receiving instructions. The two types of ports may be the same physical port. Alternatively, one or more wireless cards or adapters may provide the same functionalities as described above. The computer system 140 will have its own power separate from the microwave oven 150, so this will typically require two electrical outlets in the immediate vicinity (one for each of the microwave oven 150 and the computer 140).

The computer 140 has a microprocessor, memory, communication facilities, and storage including at least one type of mass capacity media (whether removable or not) such as hard disk, CD's (R or RW) and DVD's. The capacity of storage is sufficient for videos (typically in compressed format) of considerable duration containing program content for display. The computer system 140 includes a media player software component, such as Windows™ Media Player, QuickTime™, or RealPlayer™, which can access from the storage, decompress, and present the videos by the display screen 110. Also included is a control software component for automatic management of the content displayed to the display screen 110, such as scheduling the videos and invoking the media player software component to display the videos. The control program is also adapted to receive electronic instructions from an input means, such as the electronic interface port mentioned earlier (constantly monitoring the port), for the purpose of user-specified management, such as to change the videos or their scheduling, after authenticating the source of the instructions as a properly authorized person. The user may be a physical person or a computer system; to the control program, it would typically make no difference.

One or more audio speakers may be part of the computer system 140 in the compartment 130, part of the media microwave oven 100 otherwise, or separate from the media microwave oven 100 but electronically connected to the computer system 140 for providing the audio signal for displayed program content.

The program content of the video is limited to commercial advertising. The program may also include instructional videos of the employer, e.g. on workplace safety or corporate announcements.

In typical operation, the computer system 140 and the microwave oven 150 are entirely independent devices: the computer system 140 displays one or more videos on the display screen 110, regardless of whether the microwave oven 150 is in use or not. The repertoire of displayed videos is repeated automatically without outside intervention. In fact, except by disengaging the locking mechanism, or by providing a special code to the exteriorly-accessible electronic interface means, no one can access the computer system 140 and directly affect the displayed content.

One example of how program content may be affected is by plugging a device or an interface into an electronic interface port (such as a keyboard into a keyboard port) of the computer system 140. The control program constantly monitors the interface port. A user (whether a physical person or a system) may then enter a special code via the device or interface to gain access; once authenticated, the user can perform management tasks such as schedule different program content (by sequence and time) and perhaps replace the program content in storage in part or in entirety with content received by way of an electronic input port (from a remote source such as one located on the Internet or a computer on a local or wide-area network) or a replaced storage media (e.g. replacing a DVD in the DVD drive being part of the computer system 140). As mentioned earlier, the interface port and the input port may be the same port. Telecommunications for connecting the remote source in the case of the former can be varied: there is no limitation except possibly at the seventh application layer using the OSI Reference Model.

The use of the media microwave oven 100 is limited to show advertising (or instructional video) to employees on their meal or breaks in a workplace cafeteria. In the case of advertising, an advertising or marketing firm with the possible assistance of the employer organizes the time slots and content as to which and when certain commercials are shown. With the peak advertising time slots being lunch time and the two daily breaks. These units may be used to advertise 24 hours a day, depending on their location and the workplace hours. If these are located in a manufacturing plants cafeteria, and this plant runs 7 days a week and 24 hours a day, then the unit will be adjusted to that schedule to run continuously without stop. The location of where the media microwave oven 100 is installed will determine the advertising schedule.

It will be appreciated that the above description relates to the preferred embodiments by way of example only. Many variations on the apparatus for delivering the invention will be clear to those knowledgeable in the field, and such variations are within the scope of the invention as described and claimed, whether or not expressly described.

What is claimed is:

1. A media microwave oven for storing and showing at least one advertising or instructional video at a workplace, each of the at least one video comprising a visual and an audio component, the oven comprising:

a microwave oven, comprising a door;

a display screen attached to the door for displaying the visual component of the at least one advertising or instructional video;

a speaker for playing the audio component of the at least one advertising or instructional video;

a lockable compartment containing a computer system, the lockable compartment preventing access to the computer system by viewers at the workplace, and the computer system comprising:

a microprocessor and memory connected to the microprocessor;

storage for the at least one advertising or instructional video in an electronic format;

a first software component under control of the microprocessor for retrieving the at least one advertising or instructional video from the storage and transmitting the visual component of the at least one advertising or instructional video to the display screen and the audio component to the speaker; and a second software component under control of the microprocessor for managing a sequence and time of showing the at least one advertising or instructional video using the first software component, wherein the at least one advertising or instructional video is shown without directive input from the viewers.

2. The media microwave oven of claim 1, wherein the display screen comprises a flat panel screen that is an LCD display screen or a plasma display screen.

3. The media microwave oven of claim 1, wherein the at least one advertising or instructional video is stored on the hard disk of the computer, or on a CD or DVD played on the computer.

4. The media microwave oven in accordance with claim 1, wherein the lockable compartment is fastened to the microwave oven.

5. The media microwave oven in accordance with claim 1, wherein the lockable compartment is unlockable with a key or by a combination.

6. The media microwave oven in accordance with claim 1, wherein the video comprises a sequence of pre-recorded advertisements, at least one instructional program, a sequence of workplace announcements, a program on workplace safety, or combinations thereof.

7. The media microwave oven of claim 1, wherein the at least one advertising or instructional video is pre-downloaded from a remote source located on (1) the Internet, or (2) a computer on a local or wide-area network.

8. A media microwave oven for storing and showing at least one advertising or instructional video at a workplace, each of the at least one video comprising a visual and an audio component, comprising:

a microwave oven, comprising a door;

a display screen embedded in the door for displaying the visual component of the at least one advertising or instructional video;

a speaker for playing the audio component of the at least one advertising or instructional video;

a lockable compartment containing a computer system, the lockable compartment preventing access to the computer system by viewers at the workplace, and the computer system comprising:

a microprocessor and memory connected to the microprocessor;

storage for the at least one advertising or instructional video in an electronic format;

a first software component under control of the microprocessor for retrieving the at least one advertising or instructional video from the storage and transmitting the visual component of the at least one advertising or instructional video to the display screen and the audio component to the speaker; and a second software component under control of the microprocessor for managing a sequence and time of showing the at least one advertising or instructional video using the first software component, wherein the at least one advertising or instructional video is shown without directive input from the viewers.

9. The media microwave oven in accordance with claim 8, wherein the display screen comprises a flat panel screen.

10. The media microwave oven in accordance with claim 8, wherein the display screen comprises an LCD display screen or a plasma display screen.

11. The media microwave oven in accordance with claim 8, wherein the lockable compartment is fastened to the microwave oven.

12. The media microwave oven in accordance with claim 11, wherein the lockable compartment is fastened to an underside of the microwave oven.

13. The media microwave oven in accordance with claim 8, wherein the lockable compartment is unlockable with a key or by a combination.

14. The media microwave oven in accordance with claim 8, wherein the video comprises a sequence of short advertisements.

15. The media microwave oven in accordance with claim 8, wherein the video comprises at least one instructional program, a program on workplace safety, or combinations thereof.

16. The media microwave oven in accordance with claim 8, wherein the video comprises a sequence of workplace announcements.

17. The media microwave oven in accordance with claim 8, wherein the at least one advertising or instructional video is shown repeatedly whether or not the microwave oven is in use.

18. The media microwave oven of claim 8, wherein the at least one advertising or instructional video is stored on the hard disk of the computer, or on a CD or DVD played on the computer.

* * * * *